US008633650B2

(12) United States Patent
Sauerlaender

(10) Patent No.: US 8,633,650 B2
(45) Date of Patent: Jan. 21, 2014

(54) DIMMABLE LIGHT SOURCE WITH LIGHT TEMPERATURE SHIFT

(75) Inventor: Georg Sauerlaender, Aachen (DE)

(73) Assignee: Koninklijke Philips N.V., Eindhoven (NL)

( * ) Notice: Subject to any disclaimer, the term of this patent is extended or adjusted under 35 U.S.C. 154(b) by 142 days.

(21) Appl. No.: 13/378,381

(22) PCT Filed: Jun. 9, 2010

(86) PCT No.: PCT/IB2010/052562

§ 371 (c)(1),
(2), (4) Date: Mar. 8, 2012

(87) PCT Pub. No.: WO2010/146500

PCT Pub. Date: Dec. 23, 2010

(65) Prior Publication Data

US 2012/0153851 A1 Jun. 21, 2012

(30) Foreign Application Priority Data

Jun. 17, 2009 (EP) ..... 09162907

(51) Int. Cl.
*H05B 37/02* (2006.01)

(52) U.S. Cl.
USPC ..... 315/192; 315/294; 315/251

(58) Field of Classification Search
USPC ..... 315/192, 224, 251, 276, 294, 312, 318
See application file for complete search history.

(56) References Cited

U.S. PATENT DOCUMENTS

| | | | | |
|---|---|---|---|---|
| 2,515,236 | A | 7/1950 | Kunins | |
| 4,298,869 | A | 11/1981 | Okuno | |
| 6,285,140 | B1 | 9/2001 | Ruxton | |
| 8,531,118 | B2 * | 9/2013 | Miskin et al. | 315/185 R |
| 2005/0099143 | A1 * | 5/2005 | Kohno | 315/312 |
| 2008/0157689 | A1 * | 7/2008 | Kato | 315/185 S |
| 2009/0167202 | A1 * | 7/2009 | Miskin et al. | 315/250 |
| 2011/0210677 | A1 * | 9/2011 | Hering et al. | 315/185 R |
| 2012/0146536 | A1 * | 6/2012 | Mullen et al. | 315/251 |
| 2012/0293083 | A1 * | 11/2012 | Miskin et al. | 315/192 |

FOREIGN PATENT DOCUMENTS

WO 0101385 A1 1/2001

* cited by examiner

*Primary Examiner* — Don Le
(74) *Attorney, Agent, or Firm* — Mark L. Beloborodov

(57) ABSTRACT

An illumination device (1) comprises: mains input terminals (2, 3); a power source (30), having input terminals (31, 32) coupled to the mains input terminals and having three output terminals (33, 35, 34), one of said output terminals being a common output terminal (35). A first output (36) is defined by a first output terminal and said common output terminal; a second output (37) is defined by a second output terminal and said common output terminal. A first LED string (110) is connected to the first power source output in series with a first resistor (120). A second LED string (210) is connected to the second power source output in series with a second resistor (220). The power source is controllable to vary the voltage at the common output terminal within the range from the voltage at the first output terminal to the voltage at the second output terminal.

8 Claims, 1 Drawing Sheet

DIMMABLE LIGHT SOURCE WITH LIGHT TEMPERATURE SHIFT

FIELD OF THE INVENTION

The present invention relates in general to an illumination device comprising LEDs as light sources.

BACKGROUND OF THE INVENTION

The use of LEDs as light source for illumination rather than mere indicator lights is well known, since the development of high-power LEDs. It is also rather standard that an illumination device is powered from mains, typically 230 V@50 Hz in Europe. Since LEDs require a relatively low voltage (typically in the order of 3 V) and allow current flow in one direction only, driver circuits have been developed for generating a DC LED current on the basis of the AC mains. However, such driver circuits are relatively expensive.

In a more simple approach, a string of LEDs is connected to mains directly, in series with a ballast resistor. For allowing LED current and thus light output in both halves of the AC period, two such strings are connected anti-parallel. The idea would be that, for instance, 70 LEDs would accommodate a voltage drop of 210 V, while the remaining 20 V would be accommodated by the ballast resistor. Voltage variations would be taken up by the ballast resistor.

Although the simplicity of this approach, and hence the relatively cheap implementation thereof, has a certain attractiveness, there is a problem when it is desired that the illumination device is dimmed.

For certain applications, it is not only desired that the illumination device is dimmable, but also that the color temperature of the output light is shifted to a lower value on dimming. This requirement is specifically important in the case of small bedside lamps or reading lamps, but it may be that there are other applications where the same feature would be desirable.

SUMMARY OF THE INVENTION

An object of the present invention is to provide a simple and cost-efficient illumination device having a plurality of LEDs as light sources, capable of being dimmed in a simple manner while simultaneously the light output of the device shifts to a lower color temperature automatically.

According to an important aspect of the present invention, a power source for an illumination device comprises an autotransformer with two outputs. A first part of the LEDs are coupled to the first output, while the second part of the LEDs are coupled to the second output. Changing the setting of the autotransformer automatically changes the ratio of the output voltages and therefore the color temperature of the light output as a whole.

Further advantageous elaborations are mentioned in the dependent claims.

BRIEF DESCRIPTION OF THE DRAWINGS

These and other aspects, features and advantages of the present invention will be further explained by the following description of one or more preferred embodiments with reference to the drawings, in FIG. 1 schematically shows a block diagram of an illumination device.

DETAILED DESCRIPTION OF THE INVENTION

Figure 1:
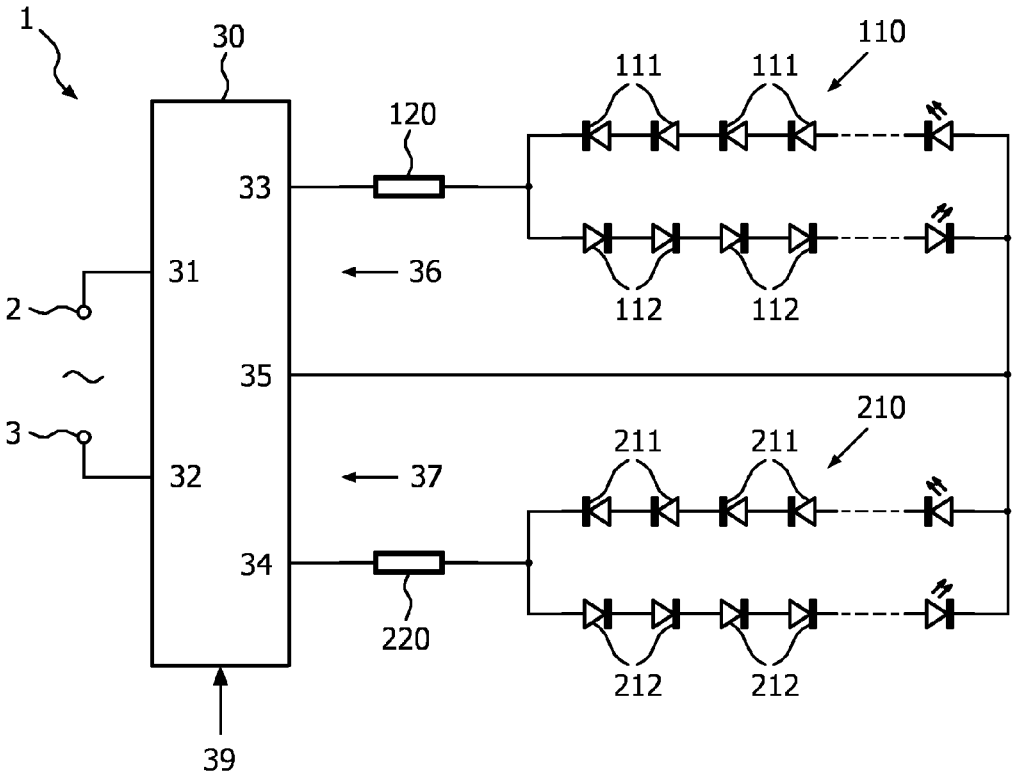

FIG. 1 schematically shows a block diagram of an illumination device 1 according to the present invention. The illumination device 1 comprises input terminals 2, 3 for coupling to AC mains. The illumination device further comprises a voltage source 30 having two input terminals 31, 32 connected to the input terminals 2, 3 of the illumination device 1, and having three output terminals 33, 34, 35. These output terminals define two outputs of the voltage source 30, one of these terminals, in this case the central terminal 35, being a common terminal. More particularly, a first output terminal 33 together with the common output terminal 35 defines a first output 36 for connecting a load, and a second output terminal 34 together with the common output terminal 35 defines a second output 37 for connecting a load.

A first string 110 of LEDs is connected in series with a first resistor 120, and this series arrangement is connected to the first output 36 of the voltage source 30. This first LED string 110 comprises a first series arrangement of power LEDs 111 and a second series arrangement of power LEDs 112 connected anti-parallel to the first series arrangement. The number of LEDs in these series arrangements is not important for understanding the present invention.

Similarly, a second string 210 of LEDs is connected in series with a second resistor 220, and this series arrangement is connected to the second output 37 of the voltage source 30. This second LED string 210 comprises a third series arrangement of power LEDs 211 and a fourth series arrangement of power LEDs 212 connected anti-parallel to the third series arrangement.

The LEDs 111, 112, 211, 212 are mounted close together in the illumination device 1, so that the overall output light as produced by the illumination device 1 as a whole, as perceived by a user, is a mixture of the individual light outputs of the individual LEDs 111, 112, 211, 212.

Typically, the LEDs 111, 112 of the first LED string 110 are preferably white power LEDs. However, it is also possible that one or more of these LEDs are colored LEDs. In any case, the design of the first series arrangement of LEDs 111 is preferably identical to the design of the second series arrangement of LEDs 112, in that they mutually have the same number of LEDs of a specific color.

Typically, the LEDs 211, 212 of the second LED string 210 are preferably red power LEDs. However, it is also possible that one or more of these LEDs have different colors. In any case, the design of the third series arrangement of LEDs 211 is preferably identical to the design of the fourth series arrangement of LEDs 212, in that they mutually have the same number of LEDs of a specific color.

In any case, the design of the third/fourth series of LEDs differs from the design of the first/second series of LEDs.

It is noted that the gist of the present invention is also applicable if the color of the second LED string 210 has a lower color temperature than the color of the first LED string 110. For instance, an embodiment would be possible where the first LED string 110 has white LEDs while the second LED string 210 has orange or yellow LEDs.

Figure 2:
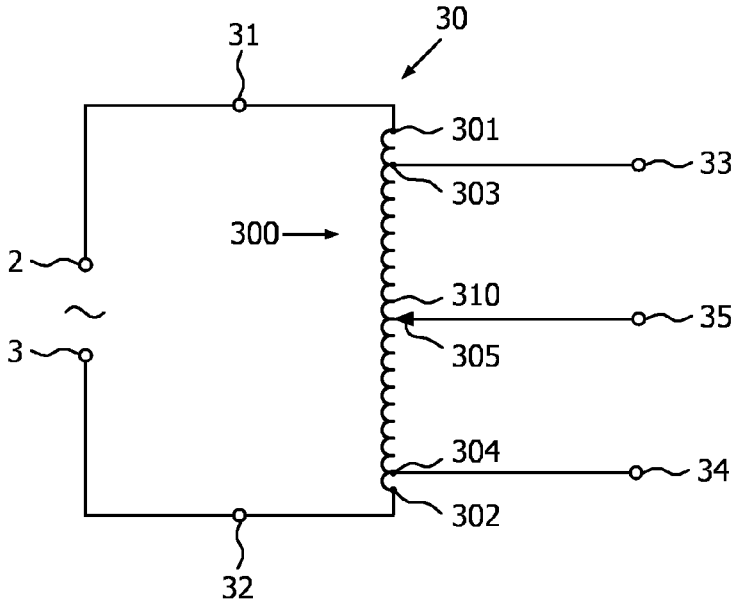
FIG. 2 schematically shows a block diagram of a preferred embodiment of a voltage source, comprising an autotransformer.

The voltage source 30 is designed so that the voltage difference between the first and second output terminals 33, 34 is always constant while the voltage at the common output terminal 35 can be varied in the range between the voltage of the first output terminal 33 and the voltage of the second output terminal 34. FIG. 2 is a block diagram schematically illustrating an embodiment of the voltage source 30 that has the advantage of structural simplicity. In this embodiment, the voltage source 30 comprises an autotransformer 300. Since autotransformers are known per se, a detailed explanation is not needed. In general, the autotransformer 300 comprises a single winding 310 having five taps 301, 302, 303, 304, 305.

A first tap 301 of the autotransformer 300 is connected to the first input terminal 31 of the voltage source 30.

A second tap 302 of the autotransformer 300 is connected to the second input terminal 32 of the voltage source 30.

A third tap 303 of the autotransformer 300 is connected to the first output terminal 33 of the voltage source 30.

A fourth tap 304 of the autotransformer 300 is connected to the second output terminal 34 of the voltage source 30.

These taps 301, 302, 303, 304 are fixed taps; thus, it will be clear that the output voltage between the first output terminal 33 and the second output terminal 34 of the voltage source 30 always has the same value as long as the input voltage remains constant. In a preferred embodiment, the third tap 303 coincides with the first tap 301 and the fourth tap 304 coincides with the second tap 302, but this is not essential for understanding the present invention.

A fifth tap 305 of the autotransformer 300 is connected to the common output terminal 35 of the voltage source 30. This fifth tap 305 is a displaceable tap, displaceable along the length of the transformer winding, so that the voltage at this tap varies in accordance with its position. The position of the displaceable tap can be adjusted by a user, for instance by handling a knob or wheel or handle (not shown) attached to the tap. Such knob or handle has the function of a user input 39 (see FIG. 1).

Assume that the first string 110 consists of white LEDs 111, 112 while the second string 210 consists of red LEDs 211, 212. When the user manipulates the user input 39 so that the voltage at the common output terminal 35 is equal to the voltage at the second output terminal 34 (fifth tap 305 moved towards to lower end in FIG. 2), the full output voltage is applied over the first string 110 of LEDs 111, 112 in series with the first resistor 120. Thus, the current in this string is at a maximum, and the light output is bright white light.

As the user manipulates the user input 39 so that the fifth tap 305 moves away from the lower end of the winding to the upper end of the winding, the voltage at the common output terminal 35 approaches the voltage at the first output terminal 33 so that the voltage over the first output 36 decreases while at the same time the voltage over the second output 37 increases. Thus, the light level of the white output light is reduced while at the same time the light level of the red output light increases. With a proper design of the series resistors 120 and 220, the overall result will be that the light output level of the illumination device is reduced (dimmed), while the relative content of red light in the output light is increased (shift to lower color temperature).

It is noted that, instead of a controllable voltage source 40, a controllable current source can be used, designed such that the total current remains constant when the current at one output is increased/decreased.

Summarizing, the present invention provides an illumination device 1 comprising mains input terminals 2, 3 and a power source 30, having input terminals 31, 32 coupled to the mains input terminals and having three having output terminals 33, 35, 34, one of said output terminals being a common output terminal 35. A first output 36 is defined by a first output terminal and said common output terminal; a second output 37 is defined by a second output terminal and said common output terminal.

A first LED string 110 is connected to the first power source output in series with a first resistor 120.

A second LED string 210 is connected to the second power source output in series with a second resistor 220.

The power source is controllable to vary the voltage at the common output terminal within the range from the voltage at the first output terminal to the voltage at the second output terminal.

While the invention has been illustrated and described in detail in the drawings and foregoing description, it should be clear to a person skilled in the art that such illustration and description are to be considered illustrative or exemplary and not restrictive. The invention is not limited to the disclosed embodiments; rather, several variations and modifications are possible within the protective scope of the invention as defined in the appending claims. For instance, each LED string may have a configuration differing from the configuration shown in FIG. 1. For example, the LED string may be implemented as a series arrangement of LED units, wherein each LED unit comprises at least one first LED connected anti-parallel to at least one second LED. Other ladder configurations are conceivable, too. Further, it is not necessary that a string has anti-parallel LEDs: if a string is provided with a bridge rectifier (not shown) or other type of rectifier, the string may consist of one-directional LEDs only, which may offer a saving in product count.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. Illumination device, comprising:

mains input terminals for coupling to AC mains;

a controllable power source, having input terminals coupled to the mains input terminals and having three having output terminals, wherein one of said output terminals is a common output terminal, wherein a first output is defined by a first output terminal and said common output terminal, and wherein a second output is defined by a second output terminal and said common output terminal;

a first LED string connected to the first power source output in series with a first resistor;

a second LED string connected to the second power source output in series with a second resistor;

wherein the controllable power source is controllable to vary the voltage at the common output terminal within the range from the voltage at the first output terminal to the voltage at the second output terminal.

2. Illumination device according to claim 1, wherein the controllable power source comprises an autotransformer, comprising a single winding having:

a first fixed tap connected to the first power source input terminal;

a second fixed tap connected to the second power source input terminal;

a third fixed tap connected to the first power source output terminal;

a fourth fixed tap connected to the second power source output terminal;

a fifth tap connected to the common power source output terminal;

wherein the fifth tap is displaceable along the winding between the position of the third fixed tap and the position of the fourth fixed tap.

3. Illumination device according to claim 1, wherein the first fixed tap coincides with the third fixed tap.

4. Illumination device according to claim 1, wherein the second fixed tap coincides with the fourth fixed tap.

5. Illumination device according to claim 1, wherein the two LED strings produce mixed light outputs, having different color temperatures.

6. Illumination device according to claim 1, wherein the first LED string comprises one or more white LEDs and wherein the second LED string comprises one or more red LEDs.

7. Illumination device according to claim 1, wherein the correlated color temperature of the overall output light of the LEDs of the second LED string is lower than the correlated color temperature of the overall output light of the LEDs of the first LED string.

8. Illumination device according to claim 1, wherein a LED string comprising a first series of power LEDs and a second series of power LEDs connected anti-parallel to the first series.

* * * * *